United States Patent [19]

Adams

[11] Patent Number: 4,586,912

[45] Date of Patent: May 6, 1986

[54] GAME CALL

[76] Inventor: Denton D. Adams, R.D. #1, Thompsontown, Pa. 17094

[21] Appl. No.: 734,035

[22] Filed: May 14, 1985

[51] Int. Cl.[4] ..... A63H 5/00; G10D 13/08

[52] U.S. Cl. ..... 446/397; 446/418; 84/410

[58] Field of Search ..... 446/205, 206, 397, 404, 446/415, 416, 417, 418, 419, 420, 421; 84/402, 410, 411, 414, 415

[56] References Cited

U.S. PATENT DOCUMENTS

| | | | |
|---|---|---|---|
| 609,068 | 8/1898 | Zeidler | 84/415 |
| 651,752 | 6/1900 | Draughon | 446/397 |
| 1,034,307 | 7/1912 | Sanders | 446/417 |
| 1,449,756 | 3/1923 | Jackson | 446/397 |
| 2,606,401 | 8/1952 | Boatwright | 446/397 |
| 2,643,483 | 6/1953 | Walker | 446/397 |
| 2,958,157 | 11/1960 | Tannehill | 446/397 |
| 3,208,184 | 9/1965 | Wisor | 446/397 |
| 3,208,185 | 9/1965 | Silvera | 446/137 |
| 3,367,064 | 2/1968 | Anthony et al. | 446/397 |
| 3,716,943 | 2/1973 | Orzetti | 446/397 |
| 3,927,490 | 12/1975 | Grayson | 446/418 |
| 4,003,159 | 1/1977 | Piper | 446/397 |
| 4,041,639 | 8/1977 | Funk | 446/397 |
| 4,310,986 | 1/1982 | Jacobs | 446/397 |
| 4,343,108 | 8/1982 | Lee | 446/397 |

*Primary Examiner*—Robert A. Hafer
*Assistant Examiner*—D. Neal Muir
*Attorney, Agent, or Firm*—Steele, Gould & Fried

[57] ABSTRACT

A game call includes a support member having a base with an upwardly extending flange around a perimeter thereof, defining a substantially U-shaped cross section. Ribs extend upwardly from the base to a height less than that of the flange. The base includes a plurality of apertures. A first planar member is adapted to be affixed to the distal ends of the ribs. A second planar member is adapted to be affixed to the distal end of the perimetric flange. A tool is provided for vibrating the second planar member, especially by scraping the tool over a roughened outer surface of the second planar member, thereby generating a game calling sound. The first and second planar members are preferably made of glass.

13 Claims, 4 Drawing Figures

GAME CALL

BACKGROUND OF THE INVENTION

1. Field of the Invention

This invention pertains to the field of game calls, and particularly to the field of game calls in which an attractive sound is generated by manual or mechanical action.

2. Description of Prior Art

Game calls for producing sounds attractive to game can be broadly defined by two classes, one in which the game sound is produced by blowing through the call, and the other in which the game sound is produced by a vibration of a mechanical sounding element. Many game calls have been devised which apply a striker to a sounding surface to produce a game calling sound. These usually include the concept of moving a striker such as a dowel across a rough sounding surface, either manually or through some connecting mechanical means. Discontinuous movement of the striker on the rough surface causes a vibration. The roughened sounding members are normally a slab of slate. Draughon, U.S. Pat. No. 651,752; Saunders, U.S. Pat. No. 1,034,307; Walker, U.S. Pat. No. 2,643,483; and Tannehill, U.S. Pat. No. 2,958,157, all teach slate sounding members. These game calls all have as their object the production of a sound at the point of contact between the striker and the sounding surface which will be effective at attracting game. Many different structures have been devised towards this goal.

Piper, U.S. Pat. No. 4,003,159, discloses a game call wherein a rod-shaped striker member is moved across a unitary sounder plate made up of a carrier having a U-shaped cross section and a sounder board, to produce an attractive sound. Jacobs, U.S. Pat. No. 4,310,986, discloses a game call wherein the two sections are interfitted for compact carrying and protection from damage. A vibratory peg is separated from a sound block to use the call. The vibratory peg is positioned more or less perpendicular to the sounding board and the end of the peg is moved across the sounding board to produce a call attractive to a wild turkey. Grayson, U.S. Pat. No. 3,927,490, discloses a turkey call comprising a piece of chalk in combination with a portion of appalachian red cedar having a cylindrical amplifying recess therein, a flat surface and a slot between the flat surface and the amplifying recess. The chalk is the rough part of this device, used to contact the cedar portion to produce a turkey-attracting sound. Tannehill, U.S. Pat. No. 2,958,157, discloses a bird call including a vibratory peg which can be interfitted with a sound producing surface for compact storage. The peg is removed and drawn across a sound producing surface to generate the bird call. Wisor, U.S. Pat. No. 3,208,184, discloses a disc-like abrasive slate portion and a second annular slate portion mounted in a housing and spaced from the first. The house is rigid. One of the slates is for roughening the striker and the other is for independently producing a sound.

A second group of calls generates game-calling vibrations by mechanical means. Boatright, U.S. Pat. No. 2,606,401, discloses a device wherein a pivotally movable section contacts a slate member to produce a game calling sound. Walker, U.S. Pat. No. 2,643,483, discloses a game calling device wherein a knob is turned to rotate a slate disc over the ends of wooden pegs, to cause the disc to vibrate and produce a game calling sound. Orzetti, U.S. Pat. No. 3,716,943, discloses a hunting call wherein a dowel is fixed to one end of a cylindrical body, which interfits with another cylindrical body housing a disc of barium ferrite. By rotating the first cylindrical body, the peg is moved across the disc of barium ferrite to produce the sound of a lost turkey. Funk, U.S. Pat. No. 4,041,639, discloses a game call with a peg held in a resilient strip movable back and forth across the top of a box housing a sounding block. By moving the strip across the top of the box, the peg is moved across the sounding block to generate a game call.

The prior disclosures include numerous examples of a peg end structure applied endwise to a slate slab for producing a vibration at the area of contact. None of the foregoing disclosures attempts to use plural or cooperatively-resonant sounding board members as a means to affect the sound produced by a peg on an outer sounding board, or to cooperatively vibrate resiliently-mounted heavy elements. According to the present invention, two sounder plates are cooperatively mounted in a somewhat-flexible chassis at a space from one another, the vibration due to contact between the striker and one plate resonating the chassis and the other plate, and producing a particularly effective call including variations and lower frequency components that interest turkeys at virtually any season of the year.

The two sounder plates are spaced from one another and from a plastic housing having openings whereby vibrations of either sound plate produce acoustic vibrations in the ambient air. Preferably, the sound plates are glass discs, sandblasted for roughening, whereby the vibration of striker contact is comparable to that achieved with slate, but the plates are formed to closer dimensional and weight tolerances, and are relatively more flexible than slate.

SUMMARY OF THE INVENTION

It is an object of the present invention to provide a game call which simulates the sound of wild animals, and especially the sound of turkeys.

It is another object of the present invention to provide a game call which is simple to operate.

It is still another object of the present invention to provide a game call which simple and inexpensive to construct.

These and other objects are accomplished by a game call having a support member having a base with an upwardly extending flange around its perimeter, the support member defining a substantially U-shaped cross section, for supporting a first sounding plate. Ribs extend upwardly from the base to a height less than that of the flange for spacing a second sounding plate between the base and the first sounding plate. A plurality of apertures are provided in the base. The first sounding plate is a planar member adapted to be affixed to the distal end of the flange around the perimeter of the base. The second sounding plate is affixed to distal ends of the ribs. Means such as a manually-movable dowel are provided for vibrating the first sounding plate, the vibrations being transmitted along the support member, thereby generating the game calling sound due to vibration of both plates.

The first and second planar members are preferably made of glass. They also are preferably provided with a roughened surface, which can be produced by sandblasting or etching.

The flange on the perimeter of the base preferably has a lip formed at the inward-facing edges of its distal end to receive the edge of the planar first sounding member. The base may be formed in the shape of a disc. The ribs preferably form a broken line of short supports aligned end to end, the supports spaced inwardly from the flange and parallel to the flange. The edge of the second sounding member is preferably disposed at a space from the ribs and from the flange.

The vibrating tool is preferably a manually-operable striker, although a mechanically-driven striker is possible. The striker may be a dowel with a handle to be applied by a roughened end to the sounding plate and drawn across the outside surface thereof in substantially circular motions to produce the game calling sound. The striker is preferably made of hard wood and is unvarnished at the applied end.

BRIEF DESCRIPTION OF THE DRAWINGS

There are shown in the drawings embodiments which were presently preferred. It should be understood, however, that the mention is not limited to the precise arrangements and instrumentalities shown.

DESCRIPTION OF THE PREFERRED EMBODIMENTS

Figure 2:
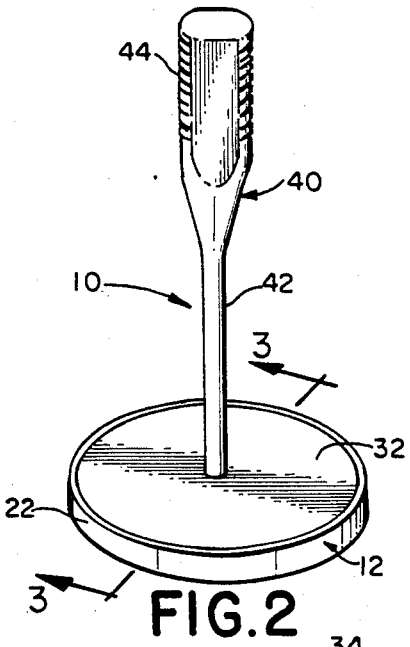
FIG. 2 is a perspective thereof, including a striker.
Figure 1:
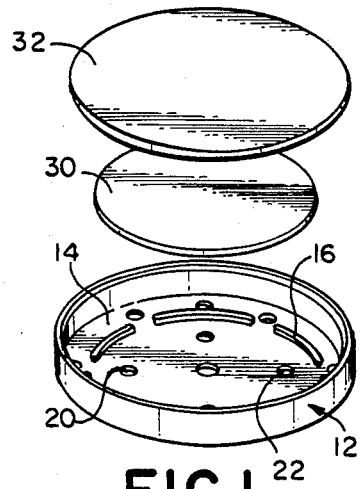
FIG. 1 is an exploded view of a game call sounding part according to the present invention.
Figure 3:
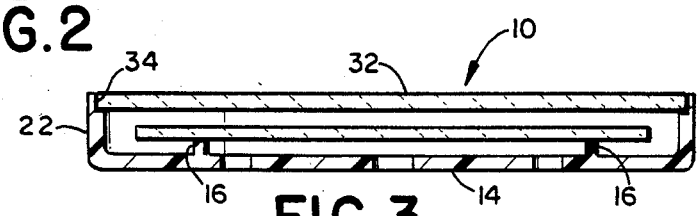
FIG. 3 is a cross sectional view taken along the line 3—3 and FIG. 2.
Figure 4:
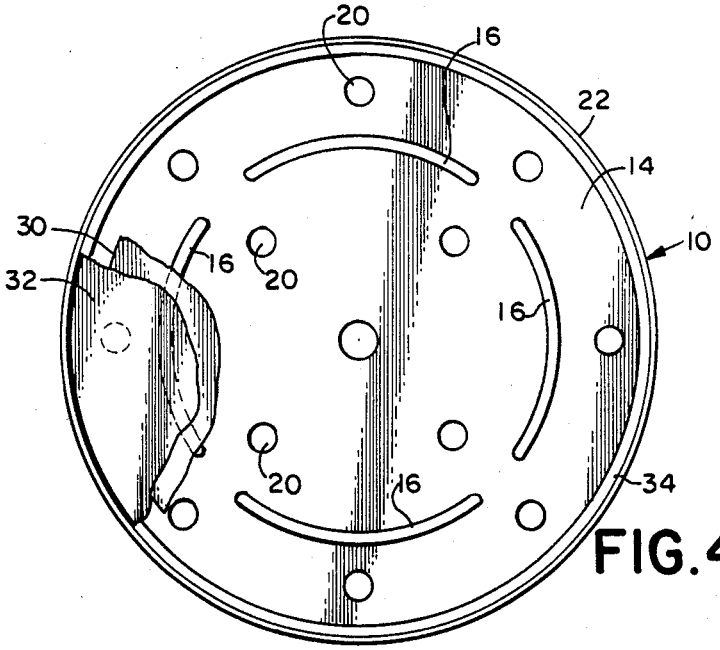
FIG. 4 is a plan view partially broken away.

Referring to FIGS. 1–4, a preferred embodiment of the game call is generally designated 10. The game call 10 includes a support member 12 which carries the sounder plates and forms a flexible interconnection thereof, whereby the sounder plates are free to vibrate and to generate sympathetic vibrations in one another. The support member 12 has a base 14 which may be disc-shaped. The base 14 is provided with a plurality of annular ribs 16 which extend upwardly from the base to a height less than that of an outer flange 22 around the perimeter. A plurality of apertures 20, preferably circular, are provided in the base, both inside and outside the annulus of the ribs. Base 14 is preferably an integrally-molded plastic part, and may be formed, for example, by modifying a plastic flower-pot base to include apertures 20 and a stepped lip 34 inside the flange 22.

An inner or resonant planar member 30 is preferably provided in the shape of a disc and is mounted on the distal edges of the ribs 16. The planar member 30 is spaced by ribs 16 from base 14 and is affixed to the ribs 16 by a suitable adhesive. An outer planar member 32 is affixed to the distal end of the flange 22 around the perimeter of the base. A lip 34, in the form of an inwardly directed, hollowed out stepped portion having an L-shaped cross section, is provided at the distal end of flange 22. Planar member 32 is tightly received by lip 34, and a suitable adhesive may be used to further secure planar member 32 to the flange 22.

The first and second planar members, and in particular the upper member 32, may be slate or other rough, substantially rigid material but are preferably made of glass. The exposed surface of the upper member 32 must be rough to properly cooperate with a striker to produce the basic game call sound. A roughened surface may be produced on glass by sandblasting the exposed surface of planar member 32.

In accordance with the invention, an outer sounding mechanism is provided by means of striker 40 and the roughened surface of the exposed sounding plate 32. The sound thereby produced, however, is only a part of the sound emitted by the game call 10. According to the invention, the outer sounder plate 32 is supported only at its extreme periphery, allowing plate 32 to vibrate as a diaphragm. All vibrations produced at plate 32 are transmitted through base 14, along flanges 22 to stand-off ribs 16, producing sympathetic vibrations in base 14, and more particularly, in inner sounder plate 30. The inner sounder plate is both an additional mass that tends to lower the resonant frequency of game call 10 as a unit. Plate 30 is also a smaller resonantly mounted device, tending to produce higher frequency components than outer plate 32 due to vibration at its own characteristic resonant frequency.

Each of the elements of the invention has a characteristic resonant frequency, by virtue of its material and dimensions, and the characteristic frequencies are altered somewhat by the interconnection of parts. Sympathetic vibrations are produced in the inner or resonant sounding plate 30 including components due to the vibration of plate 30 as defined by its mounting. A greater part of the emitted noise will be due to the contact and vibration of outer plate 32, the characteristic frequency of which is lowered by its connection to the remainder of the device. Sympathetic vibrations in the inner plate, and the resonances of the inner plate, for example between the ribs, are emitted as well, but will be substantially attenuated in comparison. According to the invention, there are separate frequency components due to contact of the striker, resonance of outer plate 32, and resonance of inner plate 30 over its whole length, between ribs 16 and around its outer periphery. Each of the separate components may also be considered to define spaced sound sources, which will cause interference patterns. Interference patterns and the fact that sound is emitted somewhat differently through apertures 22 and base 14 than directly upwardly from outer sounder plate 32 cause the overall game to have a certain directional characteristic.

The various components of sound emitted from the game call are believed to more nearly approach the variation of frequency components characteristic of a biological sound production mechanism, i.e., the sound actually produced by a live animal such as a turkey. Such a condition can be contrasted to the prior art production of a limited selection of frequencies at a relatively-higher frequency.

The inventor's use of glass rather than slate for the sounder plate material is believed to improve tolerances for production and to improve the vibration characteristics. Glass and slate are both relatively rigid, however, glass is somewhat more flexible than slate and is subject to better control of its dimensions. It will be appreciated that certain variations of the dimensions are possible, and will come within the scope of the invention. Higher or lower pitched devices can be made by suitable dimensions, for example, sounder plates which are larger in diameter will produce lower frequency characteristics, etc. Similarly, sounders of other shapes (e.g., square rather than round) will also function in a resonant manner similar to the invention, and may produce more-complicated frequency patterns.

In the preferred embodiment of the invention as pictured, the base 14 is in the form of an acrylic plastic disc about 3/32 inches thick and having a diameter of approximately 4 inches. The base 14 is provided with a plurality of circular holes, for example about a quarter inch diameter. The holes may also be in other shapes and sizes. The ribs 16 extend upwardly from the base 14 approximately one sixteenth inch, thereby spacing the inner or resonant sounder plate 30 from the outer sounder plate 32 and from the body of base 14. The resonant or inner planar member 30 is a glass sheet approximately 3½ inches in diameter and ⅛ inches thick. The outer planar member 32, to which the striker is applied, is approximately 3⅞ inches in diameter and approximately ⅛ inches thick. The ribs 16 which preferably trace a broken annular line parallel to the flange 22, are spaced approximately ½ inch inward from the flange. These dimensions can be readily altered by 50% or more, however, the noted size is preferred for sound character and for carrying convenience.

A striker 40 can be provided with a dowel-like portion 42 and a handle portion 44. The striker 40 is preferably made of a hard wood for durability. A length of sandpaper (not shown) can be attached to the base 14 for roughening the striker 40.

To operate the game call, the support member 12 is taken in one hand and the striker 40 in the other. The striker is oriented more-or-less perpendicular to plate 32 and the tip of the dowel-like portion 42 of the striker 40 is moved across the roughened outside surface of the outer planar member 32 in an arcuate path. The motion of the striker 40 across the surface of planar 32 produces a certain scraping noise, and also causes planar member 32 to vibrate. This vibration is transferred through the flange 22, base portion 14 and ribs 16, thereby also vibrating the inner planar member 30. The game calling sound therefore includes elements from spaced sources of different characteristics. Although the precise attributes of the emitted noise that are most appealing to turkeys are not specifically known, the device has been found unexpectedly effective at attracting turkeys, even outside the usual mating periods.

A game call according to the invention is capable of variations which will now become apparent to persons skilled in the art. Different forms of sympathetic vibration may also be employed in connection with game calls. For example, inasmuch as inner sounder plate 30 is a massive element operable to increase production of lower frequency components, it is possible to mount other types of weights on a housing for a sounder plate or to place weigthed members of other varieties on sympathetic vibrating elements of other types. It may also be possible to use a plurality of sympathetic vibration devices together with a device in which the scraping of a dowel on a roughened surface is used to produce the basic vibratory impetus. Additional variations are also possible. Referrence should therefore be made to the appended claims, rather than the foregoing specification, as indicating the true scope of the invention.

What is claimed is:

1. A game call comprising:

a support member having a base with a flange around a perimeter of the base and ribs extending upwardly from the base, the ribs being shorter than the flange, the base having a plurality of apertures;

an outer planar member affixed to a distal end of said flange;

a resonant inner planar member affixed to distal ends of said ribs; and means for vibrating said outer planar member, thereby generating a game calling sound through vibration of both the inner and the outer planar members.

2. The game call of claim 1 wherein the inner planar member is smaller than the outer planar member, whereby the planar members have different resonant frequencies.

3. The game call of claim 1 wherein said ribs define a broken annular line parallel to said flange.

4. The game call of claim 1 wherein said outer planar member is affixed to a lip formed in said distal end of said flange.

5. The game call of claim 1 wherein said means for vibrating includes a dowel to be endwise applied to the outer planar member, and the outer planar member has a surface adapted to cooperate with the dowel to cause vibration.

6. The game call of claim 1 wherein said outer planar member is roughened glass.

7. The game call of claim 1 wherein the outer planar member is sandblasted glass.

8. The game call of claim 2, wherein the inner planar member and the outer planar member are glass discs.

9. The game call of claim 1, wherein the inner planar member is a glass disc about 3½ inches diameter and the outer planar member is a roughened glass disc about 3⅞ inches diameter, the game call being attractive to wild turkeys.

10. The game call of claim 1, wherein the sympathetic resonating member has a subtantial mass, whereby the sympathetic resonating member limits higher frequency vibration in the planar member.

11. The game call of claim 1, wherein the sympathetic resonating member is of the same material as the planar member and of different dimensions, the sympathetic member having a different resonant frequency than the planar member.

12. The game call of claim 1, the planar member and the sympathetic resonating member are glass sheets spaced from one another by the support member.

13. The game call of claim 1, wherein the support member is flexible plastic, the support member including a disc, a flange around a perimeter of the disc carrying the planar member and a plurality of ribs carrying the sympathetic member, the ribs spacing the sympathetic member from the disc and from the planar member.

* * * * *